US006111494A

United States Patent [19]

Fischer et al.

[11] Patent Number: 6,111,494

[45] Date of Patent: Aug. 29, 2000

[54] ADJUSTABLE VOLTAGE DIVIDER PRODUCED BY HYBRID TECHNOLOGY

[75] Inventors: Werner Fischer, Heimsheim; Friedrich Vogel, Reutlingen, both of Germany; Viktor Kahr, Milan, Italy

[73] Assignee: Robert Bosch GmbH, Stuttgart, Germany

[21] Appl. No.: 09/051,027

[22] PCT Filed: Apr. 29, 1997

[86] PCT No.: PCT/DE97/00874

§ 371 Date: Sep. 28, 1998

§ 102(e) Date: Sep. 28, 1998

[87] PCT Pub. No.: WO98/06110

PCT Pub. Date: Feb. 12, 1998

[30] Foreign Application Priority Data

Aug. 3, 1996 [DE] Germany ..... 196 31 477

[51] Int. Cl.[7] ..... H01C 1/00

[52] U.S. Cl. ..... 338/320; 338/195; 338/309; 338/295

[58] Field of Search ..... 338/239, 260, 338/195, 319, 320, 325, 295, 309, 48

[56] References Cited

U.S. PATENT DOCUMENTS

| | | | |
|---|---|---|---|
| 2,758,256 | 8/1956 | Eisler | 338/309 |
| 3,601,745 | 8/1971 | Helgeland | 338/309 |
| 3,669,733 | 6/1972 | Allington | 338/309 |
| 4,505,032 | 3/1985 | Praria | 338/195 |
| 4,899,126 | 2/1990 | Yamada | 338/309 |
| 5,198,794 | 3/1993 | Sato et al. . | |

FOREIGN PATENT DOCUMENTS

| | | | |
|---|---|---|---|
| 0 093 125 B1 | 11/1983 | European Pat. Off. . | |
| 0 715 318 | 6/1996 | European Pat. Off. . | |
| 3021288 | 12/1981 | Germany | 338/195 |
| 33 44 872 | 6/1985 | Germany . | |
| 2-148801 | 6/1990 | Japan . | |
| 2039154 | 7/1980 | United Kingdom | 338/320 |

*Primary Examiner*—Lincoln Donovan
*Assistant Examiner*—Karl Easthom
*Attorney, Agent, or Firm*—Kenyon & Kenyon

[57] ABSTRACT

The invention relates to an adjustable voltage divider arrangement produced by hybrid technology, having a first current-carrying ohmic resistance layer arranged between two printed conductors and a second resistance layer, which is electrically connected to the first resistance layer and to which there is connected a third printed conductor as a pick-off electrode. A cut is made in the second resistance layer for adjusting the voltage divider so that a desired level can be picked off at the pick-off electrode. To be able to pick off very low divider voltages with the required accuracy with only a slight increase in region required by the voltage divider arrangement, it is proposed that the second resistance layer be connected to the first resistance layer over printed conductors in such a way that a first divider voltage tapped at the first resistance layer is applied to the second resistance layer, and a partial voltage of the first divider voltage can be picked off at the pick-off electrode connected to the second resistance layer.

5 Claims, 2 Drawing Sheets

ADJUSTABLE VOLTAGE DIVIDER PRODUCED BY HYBRID TECHNOLOGY

FIELD OF THE INVENTION

The present invention relates to voltage dividers produced by hybrid technology.

BACKGROUND OF THE INVENTION

An adjustable voltage divider arrangement manufactured by hybrid technology for an integrated film circuit is already known from European Patent EP 93 125. FIG. 1 shows one embodiment of this known voltage divider. FIG. 2 shows the respective equivalent circuit diagram. The voltage divider comprises a first resistance layer 1 produced by thin-film or thick-film technology, with a region 11 that serves to supply power and is connected to a printed conductor 3 and with a region 12 that serves to draw off current and is connected to a printed conductor 4. The printed conductors and resistance layers are produced from conducting paste and resistance paste that are customary in hybrid technology. The tap consists of a second resistance layer 2 which overlaps with the first resistance layer 1 in a contact zone 9 and is connected to a third printed conductor 5 which is provided as a pick-off electrode. For adjustment of the voltage divider, a laser cut or sandblasted cut 10 is made in the second resistance layer, which intersects the potential lines formed during the operation of the voltage divider. The length of cut 10 is such that the potential at pick-off electrode 5 reaches the desired level. The ohmic current-carrying voltage divider resistor of the voltage divider is formed from a single, contiguous resistance region 1 with a resistance R1 which is divided into two partial resistors R1' and R1" by the pick-off, as illustrated in FIG. 2. Since partial resistors R1' and R1" which are joined together in one piece are made of the same material with the same temperature coefficient, a temperature dependence of the voltage level picked off can be largely ruled out, in contrast to the case of a voltage divider having two spatially separate resistance layers made of different materials. Furthermore, shifting the cut required for the adjustment to the second resistance layer 2 yields the result that the potential distribution within current-carrying voltage divider resistor R1 remains essentially constant.

Despite these advantages, the known voltage divider arrangement does not meet the demands in all cases. Thus, for example, in cases when a very small divider voltage is to be picked off at resistor R1, one of the two partial resistances formed must be very small, e.g., partial resistance R1", if the divider vol age is picked off at second printed conductor 4 and third printed conductor 5. Resistance ratio R1'/R1" becomes much greater than five in these cases. This leads to problems because the region required by the voltage divider arrangement within the integrated film circuit should be as small as possible (as a rule, the length of resistance layer R1 is approximately 5 mm, the width approximately 2 mm), but at the same time, partial resistors R1' and R1" must be picked off accurately to at least one percent.

Problems arise due to the fact that, given the uniformly small region requirement, the geometric dimensions of the layer structure of the second partial resistor R1" within resistance layer 1 become too small to allow tapping with the required accuracy. Since contact zone 9 of the first and second resistance layers in FIG. 1 must be extremely small in this case, cuts into these small structures cannot be made with the required accuracy when performing the adjustment with a laser. This is true even when a cut is made with the laser directly into the first resistance layer. Therefore, partial resistors R1' and R1" cannot be picked off accurately down to one percent in the cases described here. In addition, the stability of the voltage divider declines greatly over its lifetime. The only remedy is for the geometric dimensions of the first resistance layer 1 to be increased as a whole. However, this leads to a considerable increase in the space required for the voltage divider within the integrated film circuit. For example, to go from a divider ratio of R1'/R1"=5/1 to a ratio of R1'/R1"=20/1, the region required for the voltage divider arrangement would have to be quadrupled while maintaining the same geometric size of R1".

SUMMARY OF THE INVENTION

The voltage divider arrangement according to the present invention has the advantage over the related art that even very small divider voltages can be picked off at the pick-off electrode, while at the same time the region required for the voltage divider arrangement must be increased to a much lesser extent than in the related art. This is accomplished by connecting the second resistance layer to the first resistance layer over printed conductors, rather than directly, with a first divider voltage picked off at the first resistance layer being applied to the second resistance layer. Then advantageously only a portion of this first divider voltage is picked off at the pick-off electrode connected to the second resistance layer, so that on the whole very small divider voltages can be generated. Within the integrated film circuit, the region required for the arrangement is increased only by the space needed for the additional printed conductors and by the geometric dimension of the second resistance layer. However, this additional region required is much smaller than that in the related art, so that the region required for the arrangement is not increased disproportionately even with the very small divider voltages desired.

It is advantageous in particular that the adjustment of the arrangement performed by a cut into the second resistance layer can be accomplished with the required accuracy because the geometric dimensions of the partial resistors thus formed in the first and second resistance layers do not fall below the minimum required for accurate adjustment. The partial resistors can therefore still be picked off with one percent accuracy.

It is also advantageous that the cross resistance R1'+R1" of the first resistance layer remains constant during adjustment, because adjustment is performed by a cut into the second resistance layer which is spatially separate from the first resistance layer.

It is also advantageous to provide the second and fifth printed conductors as a single-piece conductor connected to the second region of the first resistance layer, because this facilitates layout and design of the voltage divider arrangement in hybrid technology. In this case, only one printed conductor is provided as the pick-off electrode on the first resistance layer.

DETAILED DESCRIPTION OF THE INVENTION

Figure 1:
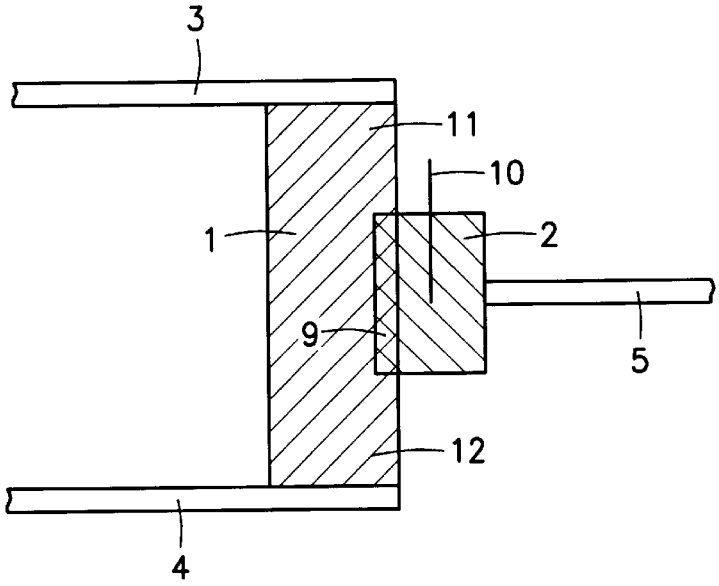
Fig. 1 Prior Art
FIG. 1 shows a known voltage divider arrangement.
Figure 2:
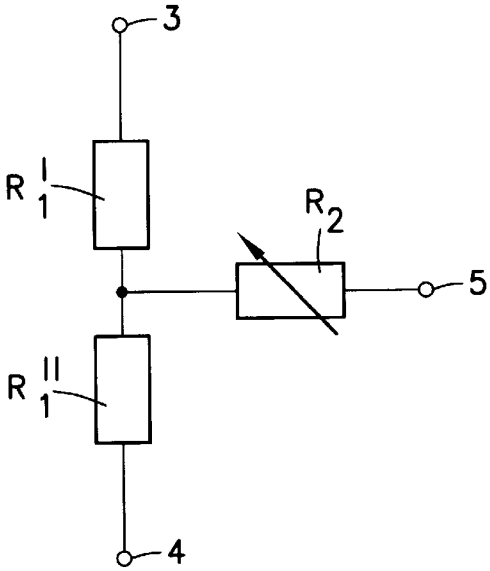
Fig. 2 Prior Art
FIG. 2 shows an equivalent circuit diagram of the voltage divider arrangement of FIG. 1.
Figure 3:
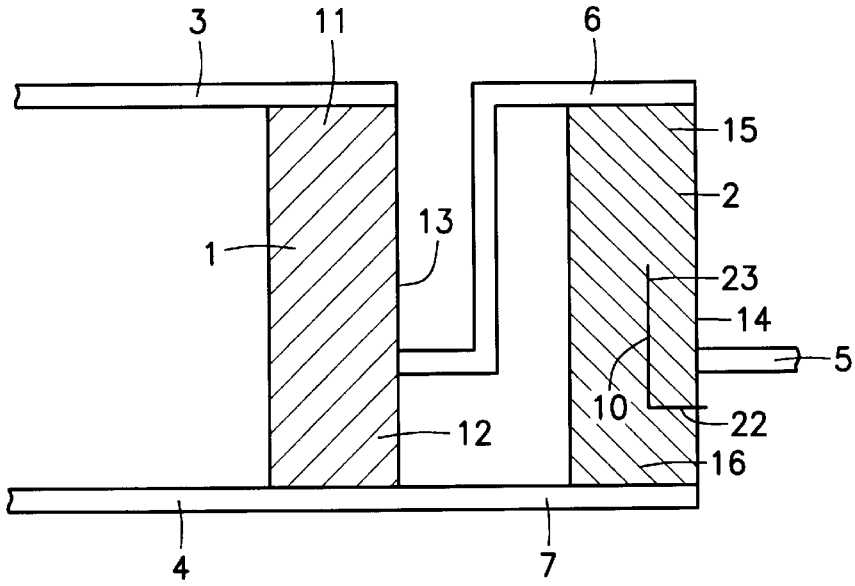
FIG. 3 shows an embodiment of a voltage divider arrangement according to the present invention.

With the embodiment of a voltage divider arrangement presented below for an integrated film circuit, resistance layers and printed conductors are made of resistance pastes and conducting pastes known from thick-film technology on a ceramic substrate. FIG. 3 shows a first embodiment of the arrangement comprising two voltage dividers connected in series. The voltage divider arrangement includes a first resistance layer (1) preferably in thick-film technology, designed as a rectangular strip. The resistance layer (1) has a first end region (11) over whose entire length a first printed conductor (3), which serves to supply power, is connected to the resistance layer (1). A second printed conductor (4) is connected to the first resistance layer (1) over the entire length of the opposite end region (12). Between the first region (11) and the second region (12), the first resistance layer (1) has an electric resistance R1. In addition, the voltage divider arrangement has a second resistance layer (2) which is designed as a rectangular strip having a first end region (15) and a second end region (16) opposite the first end region. The second end region (16) is connected to the second region (12) of the first resistance layer (1) over a printed conductor (7). Printed conductor (7) and printed conductor (4) are joined in one piece in the embodiment shown in FIG. 3, forming a common printed conductor. In addition, the first region (15) of the second resistance layer (2) is connected by another printed conductor (6) to a point intended for the voltage tap on the edge (13) between the first region (11) and the second region (12) of the resistance layer (1). In this embodiment, the printed conductor (6) serves as a pick-off electrode and divides resistor R1 into two partial resistors R1' and R1". However, it is also conceivable to connect both the printed conductor (6) and the printed conductor (7) as pick-off electrodes to the edge (13) of the resistance layer (1). It is a deciding factor that a divider voltage picked off at the first resistance layer (1) is applied over the printed conductors (6, 7) between the first region (15) and the second region (16) of the second resistance layer (2).

Figure 4:
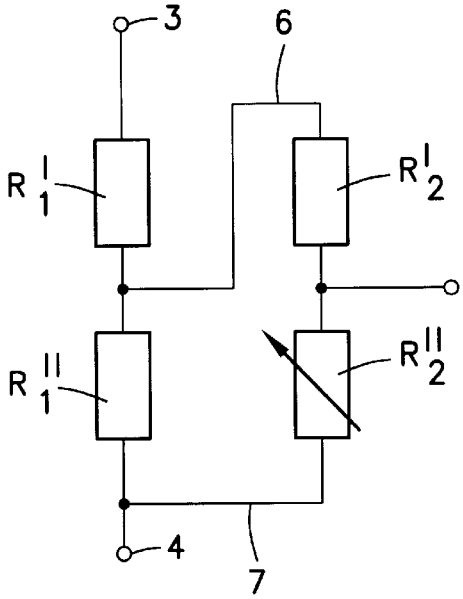
FIG. 4 shows an equivalent circuit diagram of the voltage divider arrangement of FIG. 3.

Over another printed conductor (5), a second divider voltage is picked off at the second resistance layer (2). The printed conductor (5) is provided as a pick-off electrode for the entire voltage divider arrangement and is connected to the edge (14) of the second resistance layer (2) between the first region (15) and the second region (16). The printed conductor (5) divides resistor R2 of the second resistance layer (2) into two partial resistors R2' and R2", as shown in the equivalent circuit diagram in FIG. 4; a partial voltage of the first divider voltage picked off at the first resistance layer (1) is picked off at the pick-off electrode (6) of the second resistance layer (2).

For adjustment of the voltage divider arrangement, at least one laser cut or sandblasted cut (10) is made in an L shape in the second voltage divider R2', R2" in a length such that the second divider voltage tapped at pick-off electrode 5 reaches the desired level. The L-shaped laser cut or sandblasted cut (10) is made from the edge (14) into the second resistance layer (2) and consists of a first cut (22) made crosswise in the resistance layer and a second cut (23) perpendicular to the former, extending from the second region (16) to the first region (15). A coarse adjustment is achieved with the first cut (22), while the second cut (23) provides a fine adjustment of the voltage divider arrangement. Since an elevated electric field strength occurs at the end point of the cut (10), a high degree of migration can occur there within the resistance layer, causing the cut (23) to grow back together to some extent over a period of time. However, this affects only the fine adjustment range, so this does not greatly impair the lifetime of the voltage divider arrangement.

What is claimed is:

1. An adjustable voltage divider arrangement produced by a hybrid technology, comprising:

a first current-carrying ohmic resistance layer including:

a first region connected to a first printed conductor for supplying power, and a second region connected to a second printed conductor for drawing a current from the first region; and a second resistance layer electrically connected to the first resistance layer and to a third printed conductor, the third printed conductor acting as a pick-off electrode, the second resistance layer including:

a third region connected to a fourth printed conductor, and a fourth region connected to a fifth printed conductor, wherein at least one of the fourth and fifth printed conductors is connected to the first resistance layer between the first region and the second region, the at least one of the fourth and fifth printed conductors tapping a divider voltage, wherein the third printed conductor is connected to the second resistance layer between the third region and the fourth region, and wherein the second resistance layer has a cut which is arranged to pick off a desired voltage level at the pick-off electrode.

2. The arrangement according to claim 1, wherein the fourth printed conductor is connected to the first resistance layer between the first region and the second region, and wherein the second printed conductor and the fifth printed conductor are joined as a single piece the single piece being connected to the second region.

3. The arrangement according to claim 1, wherein the divider voltage is adjusted by modifying a resistance of at least one of the first and second regions.

4. The arrangement according to claim 3, wherein the third printed conductor and the fourth printed conductor modify the resistance.

5. The arrangement according to claim 1, wherein the arrangement includes only two resistance layers.

* * * * *